United States Patent [19]

Deitz

[11] 3,931,392

[45] Jan. 6, 1976

[54] ENHANCEMENT OF ULTIMATE TENSILE STRENGTH OF CARBON FIBERS

[75] Inventor: Victor R. Deitz, Chevy Chase, Md.

[73] Assignee: The United States of America as represented by the Secretary of the Navy, Washington, D.C.

[22] Filed: Jan. 10, 1974

[21] Appl. No.: 432,773

[52] U.S. Cl. ..... 423/447; 264/29; 264/DIG. 19; 423/448; 423/460

[51] Int. Cl.[2] ..... B29C 25/00; D01F 9/12

[58] Field of Search ..... 117/46 CA; 264/29; 8/115.5; 423/447, 448, 460

[56] References Cited

UNITED STATES PATENTS

| | | | |
|---|---|---|---|
| 3,035,901 | 5/1962 | Best | 117/46 CA |
| 3,427,120 | 2/1969 | Shindo et al. | 8/115.5 |
| 3,529,934 | 9/1970 | Shindo et al. | 8/115.5 |
| 3,556,729 | 1/1971 | Holsten et al. | 8/115.5 |
| 3,627,571 | 12/1971 | Cass | 264/29 |
| 3,660,140 | 5/1972 | Scola et al. | 8/115.5 |

FOREIGN PATENTS OR APPLICATIONS

| | | | |
|---|---|---|---|
| 1,238,308 | 7/1971 | United Kingdom | 264/DIG. 19 |

*Primary Examiner*—Jay H. Woo
*Attorney, Agent, or Firm*—R. S. Sciascia; Arthur L. Branning; M. L. Crane

[57] ABSTRACT

A method of enhancing the tensile strength of carbon fibers of laboratory and commercial materials. Carbon fibers are immersed at ambient temperatures in liquid bromine or bromine dissolved in a solvent within a chemical resistant container for a period of time, the bromine is then removed by flushing with an inert gas. The removed bromine may be recovered and reused by condensing the vapor; small traces of bromine may remain within the fiber. It has been found that the bromine treatment enhances the tensile strength of the treated fiber.

8 Claims, No Drawings

ENHANCEMENT OF ULTIMATE TENSILE STRENGTH OF CARBON FIBERS

BACKGROUND OF THE INVENTION

This invention relates to a method of enhancing the tensile strength of carbon fibers and more particularly to a method of enhancing the tensile strength of carbon fibers by the use of bromine.

Early in aerospace applications a surface oxidation of carbon fiber was found necessary in order to realize acceptable interlaminar shear strength, and abrasion resistance in epoxy composites. Typical processes recently reported are: (1) I. L. Kalnin, U.S. Pat. No. 3,723,607 using ozone; (2) D. A. Scola and H. A. Hilton, U.S. Pat. No. 3,660,140 using 70% $HNO_3$; (3) R. A. Cass and S. Steingiser, U.S. Pat. No. 3,627,570 using chemical oxidation. While oxidation processes may facilitate enhanced adhesion, the tensile strength is normally diminished. In addition, it has been determined that prior art carbon fiber composites have relatively low impact strengths which limit their potential uses. Further, it has been determined that carbon fibers of different types have different strength and the need has arisen which requires modification of carbon fibers by surface treatments in order to yield the desired shear behavior of carbon fibers in composites.

Commercial carbon fibers are produced from cellulose and polyacrylo nitrile fibers by a sequence of complex chemical processes. Problems reside in the initial heating in which the nucleation of the carbon networks is controlled by a highly-sensitive oxidationpyrolysis step at about 200°–250°C; this involves complex cyclization processes combined with a chemical conversion to aromatic networks. Further problems reside in the subsequent heating process to higher temperatures during which time-temperature dependent reactions similar to many coking processes take place; which is followed by special heat treatments which may attain elevated temperatures of about 2000°C. Even with today's technology the fiber structure and surface behavior of carbon fibers are not understood.

SUMMARY OF THE INVENTION

Commercial and laboratory carbon fibers are treated with a bromine liquid or bromine dissolved in a suitable solvent for a time period of from 1 hour to several days. The major portion of the bromine is removed and recovered. Only a small quantity of bromine remains within the fiber (less than about 0.1 weight percent), but the transport of bromine by diffusing into and then out of the fiber enhances the tensile strength of the treated fibers. The percent of increase ranges from 40 to 70% for different fibers.

DETAILED DESCRIPTION

In accordance with the teaching of the method of enhancing the tensile strength of carbon fibers the method will be set forth by way of the following examples:

PAN Fiber 1 — EXAMPLE 1

A tow of experimental PAN fiber (2500 fibers per tow and several meters in length) was placed in a 250 ml flask having a ground glass stopper. The fiber assumed a coil shape around the bottom of the flask. Liquid bromine (1 ml) was introduced and the stoppered flask was allowed to sit several days. The flask was then swept with helium at room temperature. After the coloration due to bromine vapor had disappeared, the system was heated to 240°C for one hour. It was then cooled in helium to ambient temperature. The fiber remained in the stoppered flask from which samples were removed for testing.

PAN Fiber 2 — EXAMPLE 2

Several meters of a tow to Courtauld HM carbon fiber, with no surface treatment, were treated as in PAN Fiber 1 for two days. The bromine was removed at ambient temperature and condensed in a trap for future use. The fiber was then heated to 150°C in helium for one hour and then cooled. The fiber was stored in the stoppered flask from which samples were removed for testing.

PAN Fiber 3—EXAMPLE 3

Several meters of Courtauld HT carbon fiber, with no surface treatment, were treated as in PAN Fiber 2 with the exception that the flask containing the bromine and fiber was immersed in an ice bath overnight. Upon warming to room temperature the bromine was removed, the product heated to 150°C in helium, and the cooled sample stored in the stoppered container from which samples were removed for testing.

PAN Fiber 4—EXAMPLE 4

One meter length of an experimental PAN Fiber containing 1000 fibers per tow was cut into 10-cm lengths and treated as in PAN Fiber 1. The bromine was displaced with helium and the product heated slowly to 200°C. The cooled material was stored in the stoppered container and samples removed for testing.

The following table list the tensile strength of individual fibers set forth in the above examples and compares the tensile strengths before treatment with that after treatment with the percent of increase shown.

| PAN Fiber Example | Ultimate strength ($10^3$psi) Original | Treated | % Increase |
|---|---|---|---|
| 1 | 230 | 390 | 70 |
| 2 | 150 | 210 | 40 |
| 3 | 210 | 240 | 40 |
| 4 | 160 | 220 | 40 |

The load-strain measurements of single fibers were made on an Instron Testing Machine using tensile load cell A and a crosshead movement of 0.05cm/min. or 0.02cm/min. Load-strain measurements revealed non-Hookian behavior with a steady rise in modulus to the point of failure.

Fracture patterns of the original and the treated fibers were viewed with a scanning electron microscope (SEM), the fibers being fractured either by simple bending or by torsion. Definite changes were evident in the microstructure of the fracture in the fibers following bromine treatment. The fractures of the as-received fibers have a featureless appearance which extends across the complete cross-section. The bromine-treated PAN Fiber 1, Example 1, showed prominent lamellar patterns at several locations within the break. The above treatment during the diffusion of the bromine into the fiber structure apparently causes an internal rearrangement and upon the withdrawal of the bromine, the internal structure assumes a more stable configuration. The fracture pattern reveals those internal surfaces, perhaps originally present as flaws within the fiber, which the fracture planes have followed. Some fractures were recessed at the center as seen by scanning electron micrographs in sterio; the other corresponding end of the fiber protruded at the center region. Many other scanning electron micrographs showed prominent patterns that can be attributed to the bromine treatment, since they were not observed in the original fibers.

The observed changes in the fracture of the fibers after bromine treatment suggests that the entire fiber responds to the treatment. Isotherm measurements have shown that the magnitude of the bromine intercalation must be very small.

It has been demonstrated that the tensile strength of the treated carbon fibers decreases somewhat with increase in fiber length. This behavior suggests a flaw probability directly proportional to fiber length, as is well known from glass fiber investigations.

Therefore, from the above it can be concluded that carbon fibers treated with bromine are enhanced in tensile strength. Further, it has been determined that the bromine retained subsequent to treatment is only in small traces (1000ppb) which has been demonstrated by heating the fiber to 750°C in a flow of helium. From present investigation, it appears that the tensile strength improves with additional treatments, that is repetitive treatment improves the tensile strength change.

Obviously many modification and variations of the present invention are possible in light of the above teachings. It is therefore to be understood that within the scope of the appended claims the invention may be practiced otherwise than as specifically described.

What is claimed and desired to be secured by Letters Patent of the United States is:

1. A method of treating carbon fibers to enhance their tensile strength; which comprises, immersing said carbon fibers in liquid bromine within a container for a period of from about one hour to several day at ambient temperature;

removing any excess bromine from said container and said fibers;

subsequent to the disappearance of any coloration due to bromine vapor, heating the treated carbon fibers at a temperature of from about 150°C to about 250°C for about 1 hour, and cooling said heated fibers within a helium atmosphere to ambient temperature.

2. A method as claimed in claim 1; wherein said bromine is removed from said fibers by flushing the treated fibers with an inert gas at room temperature.

3. A method as claimed in claim 2; wherein said inert gas is helium.

4. A method as claimed in claim 3; wherein said treated carbon fibers are heated to a temperature of about 240°C subsequent to flushing with said helium.

5. A method as claimed in claim 4; wherein said temperature is 150°C.

6. A method as claimed in claim 4; wherein said temperature is 200°C.

7. A method as claimed in claim 3; wherein prior to removing said excess bromine said bromine immersed fibers within said container are immersed in an ice bath for a period of about 12 hours; and subsequent to cooling said fibers, warming said fibers to room temperature prior to removing said excess bromine.

8. A method as claimed in claim 3; wherein, said bromine removed from said carbon fibers is condensed and saved for further use.

* * * * *